United States Patent [19]

Lailer, Jr. et al.

[11] Patent Number: 5,064,142

[45] Date of Patent: Nov. 12, 1991

[54] APPARATUS FOR WING ATTACHMENT

[75] Inventors: Robert H. Lailer, Jr., Chelmsford; Frank K. Porter, Jr., Billerica; Laura M. Colananni, Townsend, all of Mass.; David B. Lussier, Annandale, Va.

[73] Assignee: Raytheon Company, Lexington, Mass.

[21] Appl. No.: 573,420

[22] Filed: Aug. 27, 1990

[51] Int. Cl.[5] ..... F42B 10/06

[52] U.S. Cl. ..... 244/3.24; 244/3.25

[58] Field of Search ..... 244/3.23, 3.24, 3.25

[56] References Cited

U.S. PATENT DOCUMENTS

| | | | |
|---|---|---|---|
| 2,842,058 | 7/1958 | Kuller et al. | 244/3.25 |
| 3,048,109 | 8/1962 | Feemster | 244/3.25 |
| 3,117,520 | 1/1964 | Kerr et al. | 244/3.25 |
| 3,228,335 | 1/1966 | Thompson | 244/3.25 |
| 3,276,377 | 10/1966 | Bell | 244/3.25 |
| 3,648,953 | 3/1972 | Polk | 244/3.24 |
| 4,673,146 | 6/1987 | Inglis | 244/3.23 |

FOREIGN PATENT DOCUMENTS

| | | | |
|---|---|---|---|
| 503772 | 7/1920 | France | 244/3.23 |
| 497854 | 2/1961 | France | 244/3.24 |

*Primary Examiner*—Michael J. Carone

*Attorney, Agent, or Firm*—Donald F. Mofford; Richard M. Sharkansky

[57] ABSTRACT

A saddle for restraining vibration of a wing of a missile. The saddle has a grooved portion adapted to receive the wing. The saddle has two legs extending away from the grooved portion which are secured to the missile.

9 Claims, 2 Drawing Sheets

APPARATUS FOR WING ATTACHMENT

The Government has rights in this invention pursuant to Contract No. F08635-87-C-0065 awarded by the Department of the Air Force.

BACKGROUND OF THE INVENTION

This invention relates generally to missiles and more particularly to apparatus for attaching wings to missiles.

Missiles in flight are controlled and stabilized by wings attached to the missile body. The wings, however, can be easily damaged while the missile is being transported or stored before it is fired. To avoid damage and to facilitate mounting the missile on an airplane, the wings are often made so that they can be detached while the missile is being transported and then quickly installed after the missile is loaded on an airplane.

One removable wing design uses a "locking ball". The wing includes a post. A plurality of balls are fabricated in the end of the post. The balls can retract into the post or be locked in a position protruding from the post. The missile is made with a hole (also called a "bore") large enough to receive the post and balls when retracted.

To attach the wing, the post is inserted into the bore until the portion of the post with the balls extends through the bore. A locking mechanism then releases the balls and they prevent the post from sliding back out of the bore. Since the balls cannot fit through the bore, the wing is attached to the missile.

To prevent the wing from rotating around the post, a pin is attached to the surface of the wing which butts against the missile. The pin fits into a hole in the missile body.

This method of attaching wings is adequate for many applications. However, this method of attachment may not be adequate to prevent the wing from fluttering or vibrating in the presence of air turbulence as the missile flies. The problem of wing vibration is exacerbated because the pin and the hole into which the pin fits tend to wear away as the wing vibrates. As the pin fits less snugly into the hole, the vibration becomes worse.

A small amount of vibration and wear caused by vibration of the wing is acceptable. Too much wear, however, degrades the performance of the missile. Over time, the wing vibration will increase until the wear becomes unacceptably large, allowing the wing to flutter. In designing a missile, the means for securing the wing must keep the wing vibration and wear at acceptable levels over the useful life of the missile. For missiles which are carried on airplanes before they are fired, wing vibration while the missile is mounted on the airplane must also be considered.

Air turbulence is a very complicated phenomenon. While models of airplanes and missiles in flight can be used to estimate air turbulence, the actual amount of turbulence in some situations may deviate sharply from the amount predicted by the models. A missile designer, therefore, may underestimate the amount of turbulence a missile wing is exposed to over its life. Consequently, the method of attaching wings to missiles may not be adequate to keep wing flutter at acceptable levels over the lifetime of the missile.

When it is discovered that the design of a missile is inadequate for any reason, it is often very difficult and costly to change the design. Every design change must be carefully evaluated to determine its impact on the performance of the missile. For example, the impact on performance of any added weight or drag of any change must be determined.

Changing the method of attaching wings poses unique problems. It is often necessary for aerodynamic reasons to mount a set of wings over the motor of the missile. If changing the method of attaching wings requires recessing parts into the missile or attaching parts to the missile, changes to the motor may be needed. Since the motor comprises a highly pressurized vessel, any changes to the motor must be carefully scrutinized. It must be determined that the changes to the motor design do not create weaknesses in the pressurized vessel. The testing needed to make this determination is very time consuming and undesirable.

SUMMARY OF THE INVENTION

With the foregoing background in mind, it is an object of this invention to provide apparatus for attaching a wing to a missile which reduces vibration induced wear and its associated negative effects.

It is also an object of this invention to provide apparatus for attaching a wing to a missile which will not require modifications to the motor of the missile.

It is yet a further object of this invention to provide apparatus to reduce wing wear which can be added to missiles with wings attached using a locking ball.

The foregoing and other objects are achieved through the use of a wing saddle. The saddle is mounted to the missile body forward of the motor. A portion of the saddle projects to the rear, over the motor. The portion of the saddle over the motor has a groove formed in it. The wing has a recessed portion which fits into the groove, thereby restraining flutter of the wing.

In one embodiment of the invention, the saddle is removably secured to the missile body using screws allowing replacement of the saddle.

BRIEF DESCRIPTION OF THE DRAWINGS

The invention will be better understood by reference to the following more detailed description and accompanying drawings in which.

DESCRIPTION OF THE PREFERRED EMBODIMENTS

Figure 1:
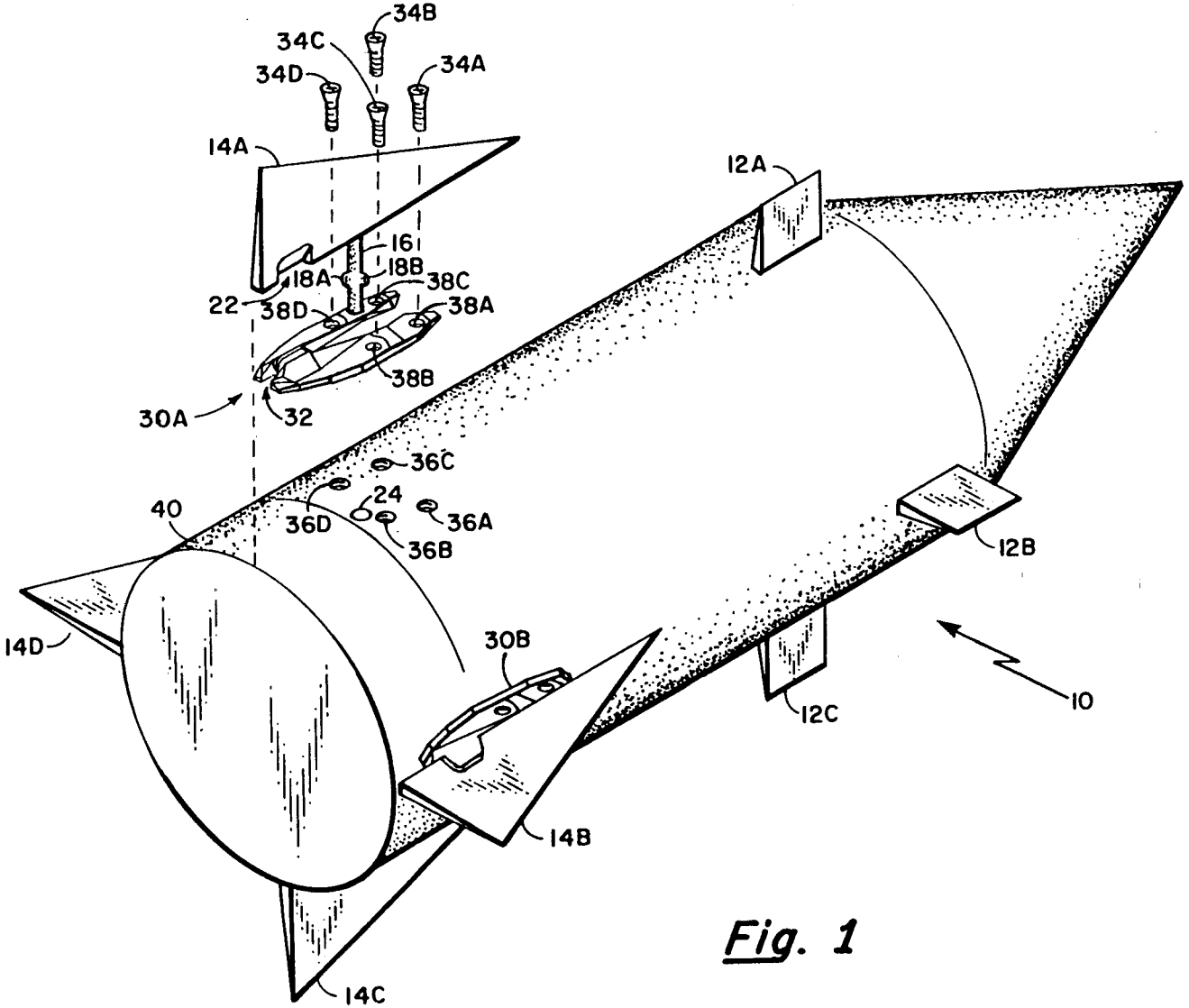
FIG. 1 is an exploded view of a missile incorporating the invention.

FIG. 1 shows a simplified isometric view of a missile 10. Missile 10 has fins (sometimes also called "control surfaces") 12A, 12B, 12C, and a fourth fin (not shown). The fins are for guidance and stabilization of missile 10. The fins are attached in any known manner. Here, the fins are attached in the forward part of the missile 10. However, in some missile designs, the fins are attached to the rear sections of the missile.

Missile 10 also has wings 14A. . .14D. Wings 14A. . .14D are attached to missile 10 using a "locking ball" arrangement which is known in the art. The details of attachment are shown for wing 14A, but all four wings are attached in the same manner.

Wing 14A has a post 16 projecting from it. Post 16 has a plurality of balls 18A and 18B (shown as representative) on one end. Post 16 fits into hole 24.

To mount wing 14A, post 16 is inserted into hole 24. A locking mechanism of the type known in the art is then engaged to extend balls 18A and 18B. Since post 16 with balls 18A and 18B extended is bigger than the opening of hole 24, post 16 is restrained in hole 24. Wing 14A is thus secured to the body of missile 10.

It will be noted that the locking ball arrangement secures wing 14A to missile 10 at only one point. Wing 14A is, thus, free to rotate around this point. Wing saddle 30A holds wing 14A to prevent rotation. It also greatly reduces wear on hole 24 experienced in prior art missiles.

Saddle 30A is made from materials used in missile construction, here D6AC steel. Saddle 30A is mounted to missile 10 via screws 34A. . .34D. Screws 34A. . .34D pass through holes 38A. . .38D, respectively, in saddle 30A and into holes 36A. . .36D, respectively, in missile 10. Wing 14A has a recess (sometimes called a "spot face") 22 which fits into clevis 32 of saddle 30A. Clevis 32 thus restrains wing 14A from rotating.

It is important to note that the rear portion of missile 10 is motor 40. Clevis 32 is over motor 40. However, holes 36A. . .36D are forward of motor 40. Mounting saddle 30A requires no structural changes in motor 40, but provides a restraining force above it.

The placement of clevis 32 determines the location where restraining force is applied to wing 14A. To prevent rotation around post 16, clevis 32 is preferably spaced apart from post 16. To prevent rotation, clevis 32 must contact wing 14A at a point where the wing is thick enough not to bend at the point where the restoring force is applied. For aerodynamic reasons, wing 14A is thinner at its forward end and thicker at its rear end. Thus, clevis 32 is preferably spaced to the rear of post 16. To reduce pressure on the wing at recess 22, clevis 32 should be as far from post 16 as possible. If wing 14A tapers at the rear end, the wing thickness at recess 22 must be thick enough to withstand the pressure. Here, the thickness is around 1/10 of an inch.

Figure 2:
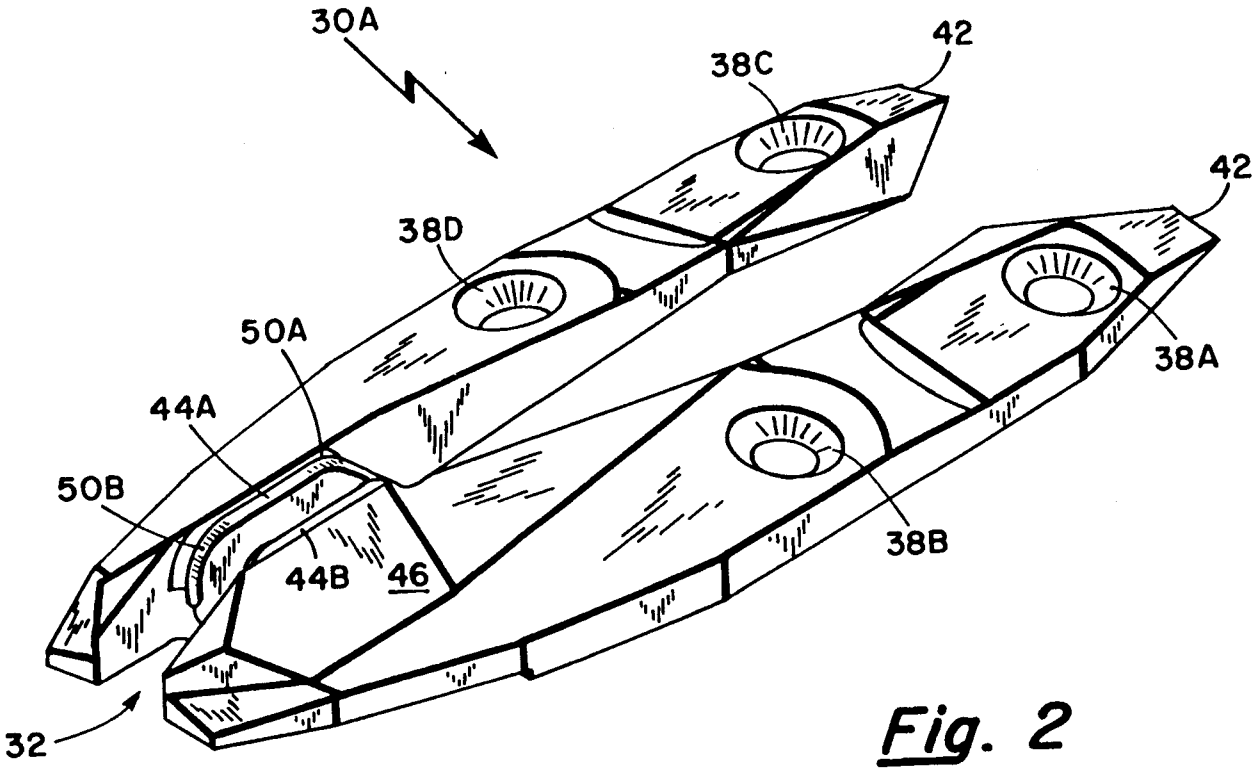
FIG. 2 is a more detailed isometric view of the wing saddle in FIG. 1.

Turning to FIG. 2, more details of saddle 30A are shown. FIG. 2 shows that saddle 30A is aerodynamically shaped so as not to excessively increase drag when it is mounted on missile 10. The exact shape will differ depending on such factors as the shape of missile 10, the shape of wing 14A, and the placement of wing 14A on missile. The aerodynamic shape of saddle 30A is preferably developed using known design and simulation techniques.

The general shape of saddle 30A lends to the aerodynamic design. For example, the forward edge 42 is tapered to reduce drag. Also, holes 38A. . .38D are countersunk holes so that screws 34A. . .34D (FIG. 1) will not project above the surface of saddle 30A. Additionally, wall 44B of clevis 32 is shaped to fit into recess 22 (FIG. 1). Likewise, wall 44A is shaped to fit into an identical recess (not shown) on the opposite side of wing 14A. This arrangement allows side 46 of saddle 30A to taper gradually away from wing 14A.

In constructing saddle 30A, the width of clevis 32 is selected to be slightly wider than thickness of the portion of wing 14A (FIG. 1) inserted in clevis 32. Moreover, walls 44A and 44B taper outward slightly. This design allows wing 14A (FIG. 1) a slight amount of play, here a maximum of 0.005" to facilitate quick installation and removal of wing 14A.

It should also be noted that any edges of saddle 30A in contact with wing 14A are rounded. For example, corners 50A and 50B are rounded. Without this rounding, it has been found that wing 14A tends to develop cracks at the point of contact between saddle 30A and wing 14A.

Having described one embodiment of the invention, it will be apparent to one of skill in the art that various modifications could be made. For example, the shape of saddle 30A could be changed to provide less drag. The location of clevis 32 relative to post 16 could change. Also, other methods of attaching saddle 30A to missile 10 could be used. The disclosed embodiment showed screws used for attachment. This method allows for the saddle to be replaced if vibration causes the groove to wear out. However, welding or other techniques could be used to attach the saddle to the missile. It is felt, therefore, that this invention should be limited only by the spirit and scope of the appended claims.

What is claimed is:

1. A member for mounting a wing to a missile, the member comprising:

(a) a first portion having a groove disposed therein, the groove being adapted to have inserted therein the wing; and (b) a second portion extending from the first portion, said second portion comprising means adaptable for securing said second portion to a surface of the missile, with said first and second portions adapted to be mounted external to the missile.

2. The member of claim 1 further comprising:

a third portion extending away from the first portion and substantially parallel to the second portion, said third portion comprising means adaptable for securing said third portion to the surface of the missile, said third portion adapted to be mounted external to the missile.

3. A member for mounting a wing to a missile having a motor comprising:

(a) a first portion having a groove disposed therein;

(b) a second portion and a third portion, each extending away from the first portion and each having means adaptable for securing said respective portions to the missile with the first portion adapted to be disposed above the motor of the missile and the second portion and the third portion of the member adapted to be secured to the surface of the missile away from the motor.

4. The member of claim 3 wherein the second and third portions of the member are secured to the surface of the missile using screws.

5. The member of claim 4 wherein the groove is dimensioned such that the portion of the wing in the groove is spaced apart from the walls of the groove by a tolerance of 0.003 to 0.005 inches.

6. A missile comprising:

a) a shell;

b) a motor surrounded by the shell;

c) a wing mounted to the shell, said wing having a portion disposed above the motor;

d) first means, disposed above the motor, for restraining motion of the wing; and e) second means, secured to the shell at a point away from the motor, for securing the first means.

7. The missile of claim 6 wherein the first means comprises a first body having a groove formed therein.

8. The missile of claim 7 wherein the second means comprises two bodies connected to and extending away from the first body.

9. The missile of claim 7 wherein:

(a) the wing has a recess formed therein; and (b) the portion of the wing having the recess is disposed in the groove.

* * * * *